US005357223A

United States Patent [19]

Forgeot

[11] Patent Number: 5,357,223

[45] Date of Patent: Oct. 18, 1994

[54] CONNECTION DEVICE BETWEEN AN ANTENNA AND A MICROELECTRONIC ENCLOSURE

[75] Inventor: Olivier Forgeot, Fontenay le Fleury, France

[73] Assignee: Dassault Electronique, Saint Cloud, France

[21] Appl. No.: 22,927

[22] Filed: Feb. 26, 1993

[30] Foreign Application Priority Data

Feb. 26, 1992 [FR] France ..... 92 02236

[51] Int. Cl.[5] ..... H01P 5/10

[52] U.S. Cl. ..... 333/26; 333/260; 343/859; 343/906; 439/63

[58] Field of Search ..... 333/26, 246, 260; 439/63, 578, 581; 343/859, 906

[56] References Cited

U.S. PATENT DOCUMENTS

| | | | |
|---|---|---|---|
| 4,287,603 | 9/1981 | Moser | 455/293 |
| 4,733,202 | 3/1988 | Forterre et al. | 333/26 |
| 4,797,684 | 1/1989 | Bernstein et al. | 343/895 |
| 4,999,592 | 3/1991 | Kanda et al. | 333/26 |
| 5,198,786 | 3/1993 | Russell et al. | 333/26 |

FOREIGN PATENT DOCUMENTS

| | | | |
|---|---|---|---|
| 0393875 | 10/1990 | European Pat. Off. . | |
| 199902 | 8/1990 | Japan | 333/260 |

OTHER PUBLICATIONS

Ogawa et al., "A 50 GHz GaAs FET MIC Transmitter/Receiver Using Hermetic Miniature Probe Transitions," IEEE Transactions on Microwave Theory and Techniques, vol. 37, No. 9, Sep. 1989, pp. 1434–1441.

B. Climer, "Analysis of Suspended Microstrip Taper Baluns," IEE Proceedings, vol. 135, No. 2, Apr. 1988, pp. 65–69.

T. E. Morgan, "Spiral Antennas for ESM," IEE Proceedings, vol. 132, No. 4, Jul. 1985, pp. 245–251.

*Primary Examiner*—Paul Gensler

*Attorney, Agent, or Firm*—Foley & Lardner

[57] ABSTRACT

An electronic device includes an antenna enclosure provided with a circuit on which an antenna is etched and a balun circuit for feeding the antenna, itself connected to a microelectronic enclosure fitted with an airtight connection having a sealed glass bead with at least one conducting wire passing through it. The balun circuit has at least two different tracks on each side of a dielectric substrate. At least one immediate electrical contact is provided between the conducting wire of the enclosure and one of the tracks of the balun circuit, at the same time as a direct mechanical fixing of the antenna enclosure to the microelectronic enclosure, accompanied by another connection of the same type or an earth transfer conductor which is connected to the other balun track and is in contact with the microelectronic enclosure.

6 Claims, 5 Drawing Sheets

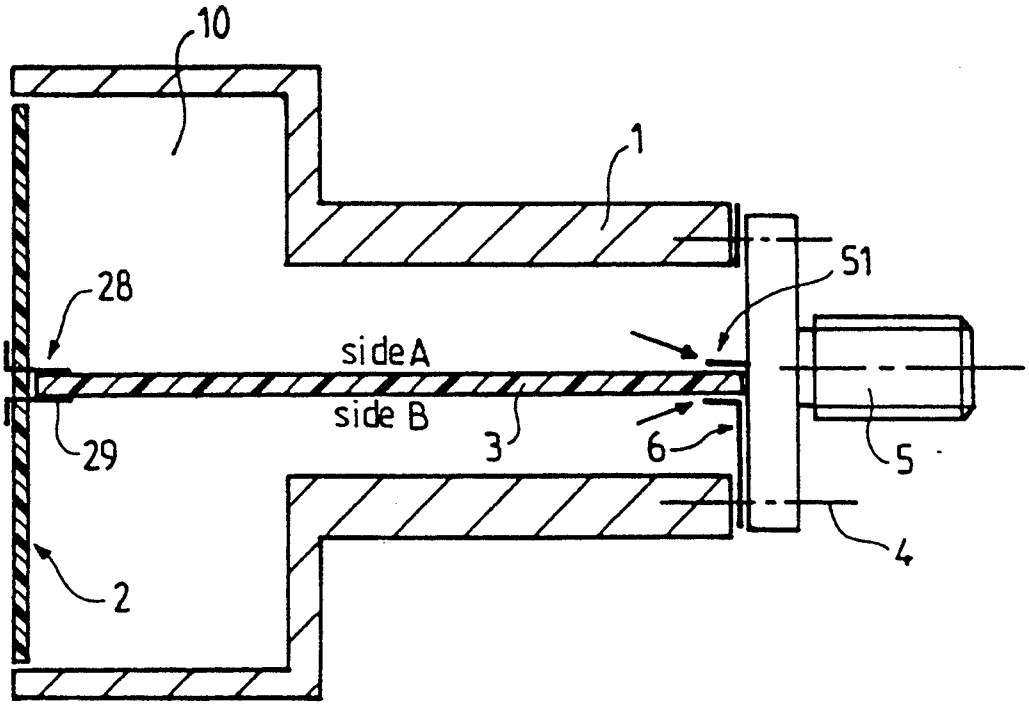
FIG. 3
(PRIOR ART)
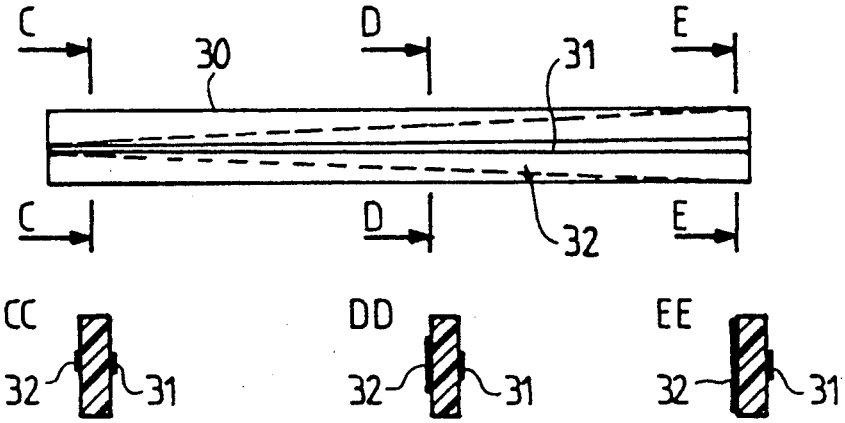
FIG. 4
(PRIOR ART)
FIG. 4A FIG. 4B FIG. 4C

CONNECTION DEVICE BETWEEN AN ANTENNA AND A MICROELECTRONIC ENCLOSURE

BACKGROUND OF THE INVENTION

The invention concerns a new method of connection between an antenna and a microelectronic enclosure.

It is known that UHF electronic enclosures are conventionally fitted with connectors and connected by one or more coaxial cables or, in the case of high power levels, by waveguides. For applications on board aircraft, the total space requirement for such equipment including several enclosures is often critical. This is particularly the case with the connection of an antenna to the UHF enclosure which controls it.

SUMMARY OF THE INVENTION

The present invention aims to propose a solution to the problem consisting of minimizing this space requirement.

The electronic device proposed is of the type comprising an antenna enclosure provided with a circuit on which an antenna is etched and a balun circuit for feeding this antenna, connected to a microelectronic enclosure provided with an airtight connection consisting of a sealed glass bead with at least one conducting wire passing through it.

According to the invention, the balun circuit comprises at least two different tracks, on each side of a dielectric substrate; and it is provided with at least one immediate electrical contact between the conducting wire from the enclosure and one of the tracks of the balun circuit, at the same time as a direct mechanical fixing, in particular by screws, of the antenna enclosure to the microelectronic enclosure, accompanied by an earth transfer conductor, preferably an angle bracket, which on the one hand is connected to the other balun track and on the other hand is in contact with the microelectronic enclosure.

In one embodiment, the immediate contact between the wire from the enclosure and the antenna balun is achieved by soldering.

In another embodiment, the immediate contact between the wire from the enclosure and the antenna balun uses a clamp soldered to the balun and intended to receive the conducting wire from the microelectronic enclosure.

For some applications, the glass bead on the enclosure has several conducting wires passing through it, each wire being received in a corresponding clamp soldered directly to the balun. The clamps may all be situated on the same side of the balun or on the other hand distributed on both sides of the balun.

Other characteristics and advantages of the invention will be clear from the following description and the accompanying drawings.

BRIEF DESCRIPTION OF THE DRAWINGS

FIG. 3 shows a method of fixing, according to the prior art, a connector to a spiral antenna fed by a balun, FIG. 4 shows the wide-band progressive printed balun of the MINERVA type, and FIGS. 4A, 4B, and 4C are sectional views thereof.

DETAILED DESCRIPTION OF PREFERRED EMBODIMENTS OF THE INVENTION

Figure 1:
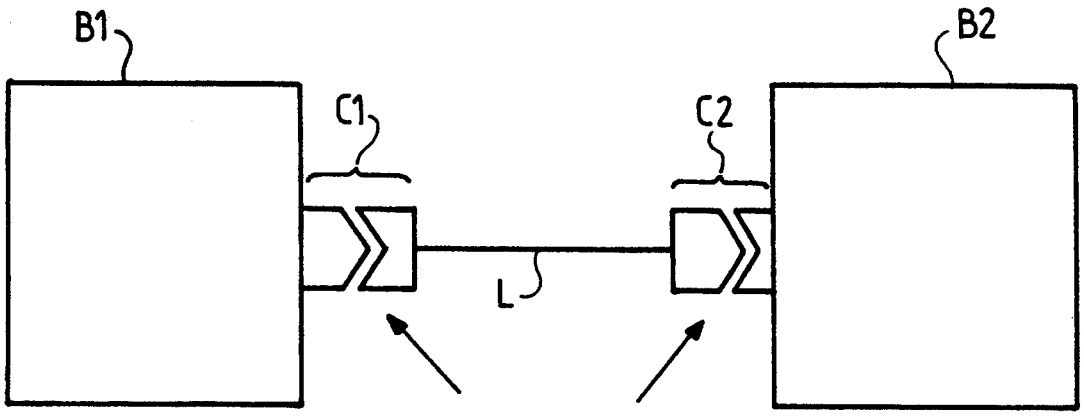
FIG. 1 (PRIOR ART)
FIG. 1 is a diagrammatic representation of a conventional system of connection between two enclosures.

FIG. 1 shows diagrammatically a conventional method of connection between enclosures B1, B2 in which electronic functions are installed: one or more coaxial cables L transmit UHF signals. Connectors C1, C2 provide a facility for fitting and removing all these components. In the case of high power levels, waveguides may effectively replace the cables.

In some fields of use, particularly in electronic systems on board aircraft, the total space requirement for equipment including several enclosures is critical and attempts are made to minimize the distance separating two adjacent enclosures.

Figure 2:
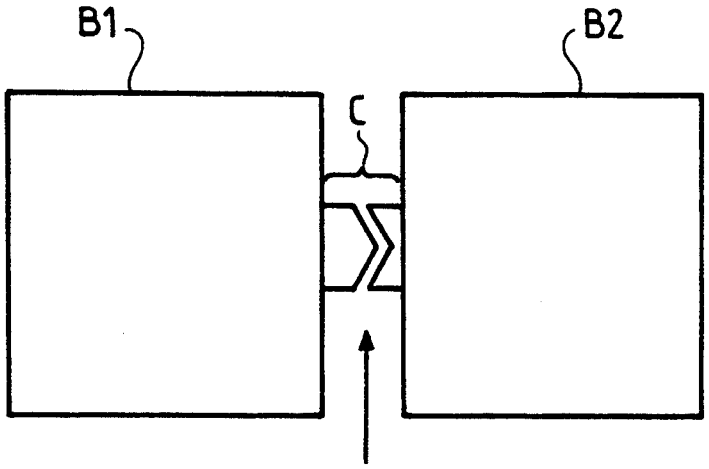
FIG. 2 (PRIOR ART)
FIG. 2 illustrates an antenna/UHF enclosure connection, without any connecting cable.

In the case of the connection of an antenna to a UHF enclosure, space is already being saved by eliminating the connection cable and half the connectors (FIG. 2).

FIGS. 3 to 5 illustrate the application to an antenna enclosure, with its balun, connected to an electronic enclosure, the function of which is for example the amplification, mixing, filtering or detection of the signal. The antenna (FIG. 3) consists of a enclosure or "antenna body" 1, defining a cavity 10 which is for example a symmetrical cylinder in shape. At an open end of this enclosure a circuit 2 is fixed, for example made from Teflon-glass, and on which the antenna is etched, for example in the form of a double-strand spiral. The latter is fed via connecting wires 28, 29 by a wide-band progressive printed balun 3 of the MINERVA type, which will be described now with reference to FIG. 4.

The balun is mounted on a Teflon-glass substrate 30. It comprises on the top (side A) an axial metallized track 31 broadening slightly towards the right, and on the bottom (side B) an axial metallized track 32 broadening greatly towards the right (sections in FIGS. 4A, 4B and 4C).

At the right-hand end of the enclosure, a connector element 5 is fixed in a conventional manner (screw 4). The core 51 of the connector is soldered to the balun on the narrow track side 31; its wide track 32 is soldered to an angle bracket 6 for transferring the electrical earth (UHF), fixed to the connector 5.

Figure 5A:
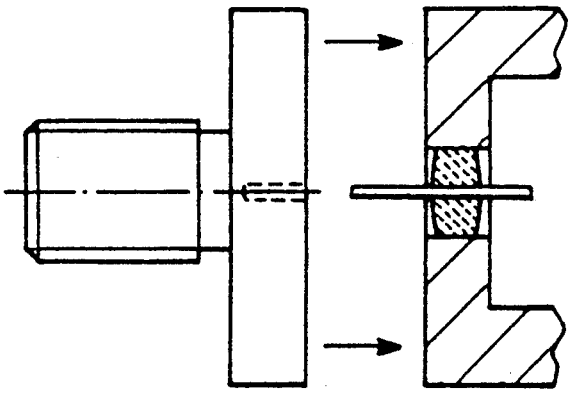
FIG. 5A (PRIOR ART)
FIGS. 5A and 5B show a system, according to the prior art, for fixing a connector to a microelectronic enclosure.
Figure 5B:
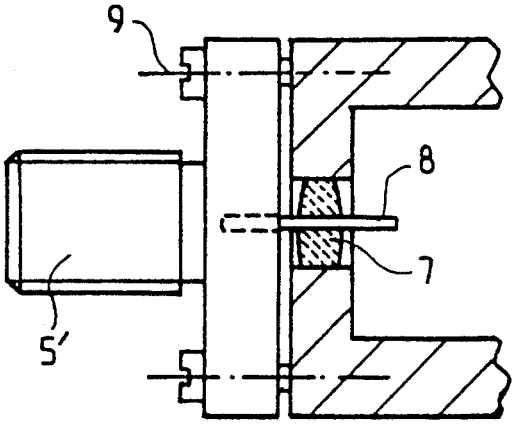
FIG. 5B (PRIOR ART)

FIGS. 5A and 5B illustrate how a conventional connector is fixed to a microelectronic enclosure. FIG. 5A illustrates how the components are linked and FIG. 5B illustrates the assembled unit.

The microelectronic enclosure (FIGS. 5A and 5B) is for example made from aluminium or KOVAR. Its corresponding (left-hand) wall comprises one or more sealed airtight connections, in the form of glass beads 7 with conducting wires 8 passing through them. A connector with a base 5', for example of the SMA type, is fixed by clamping on the conducting wire 8. The connector and enclosure are connected mechanically by fixing screws 9.

According to the present invention, it is proposed, in order to resolve the problem posed by the space requirement for the two enclosures joined by the connectors 5 and 5' to dispense with the latter and to fix the enclosure directly to the body of the antenna.

Figure 6:
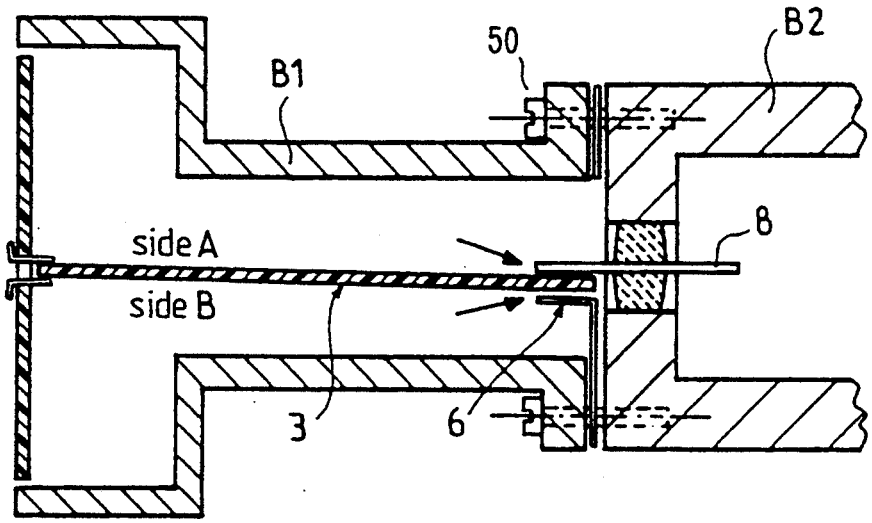
FIG. 6 shows an antenna/electronic enclosure fixing system according to a first embodiment of the invention.

This is illustrated in FIG. 6, in which the following can be seen:

mechanical fixing of the enclosure to the body of the antenna, for example screw 50, direct electrical contact between the conductor 8 and the narrow track 31 of the balun 3.

According to the first embodiment (FIG. 6), the contact between the narrow track 31 of the balun 3 and the central conductor 8 of the glass bead is achieved by soldering. The earthing angle bracket, fixed between the enclosures B1 and B2, is soldered to the broad track 32 of the balun 3. Although contrary to normal practice, it has proved that this device functions satisfactorily.

Nevertheless, because it is soldered it may be difficult to dismantle this arrangement. Such dismantling is often required in order to perform radio tests or antenna adjustment operations.

Figure 7:
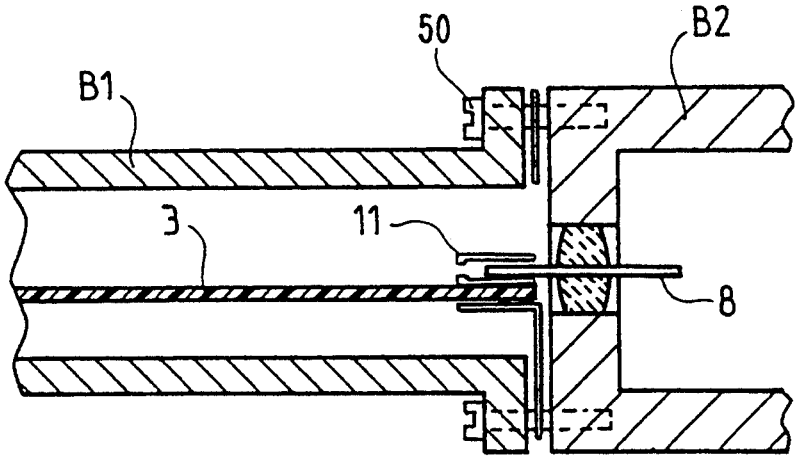
FIG. 7 presents a second embodiment of the invention.

A second embodiment of the invention is illustrated in FIG. 7. A clamp 11 is soldered to the narrow track 31 of the balun and makes it possible to fix removably, by clamping, the conductor 8 associated with the microelectronic enclosure. The earthing angle bracket, fixed to the enclosure B1, is soldered to the wide track 32 of the balun 3.

Figure 8:
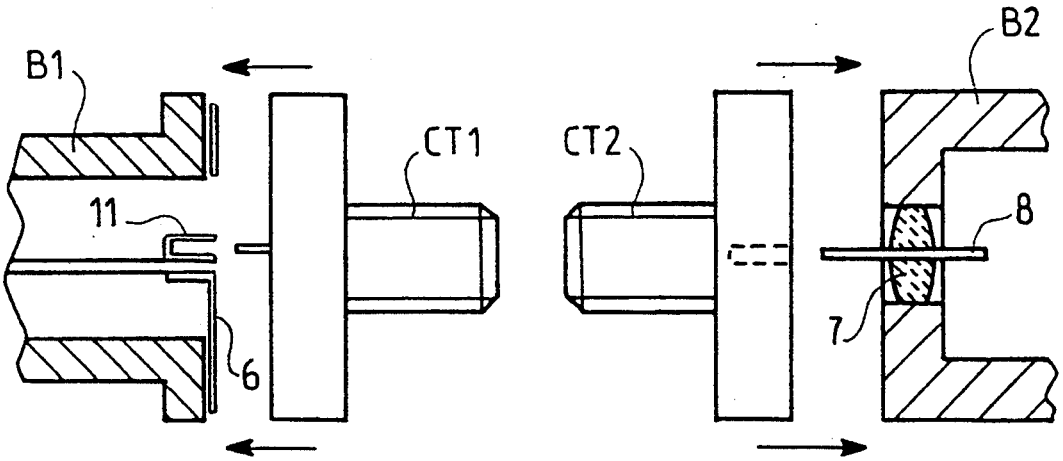
FIG. 8 illustrates the use of test connectors after dismantling the antenna and enclosure fixed according to one of the embodiments of the invention.

The tests can then be carried out easily since the assembly is immediately demountable. These tests are advantageously carried out by means of test connectors CT1, CT2, mounted in a temporary manner on the antenna and/or on the enclosure during such tests (FIG. 8).

Figure 9:
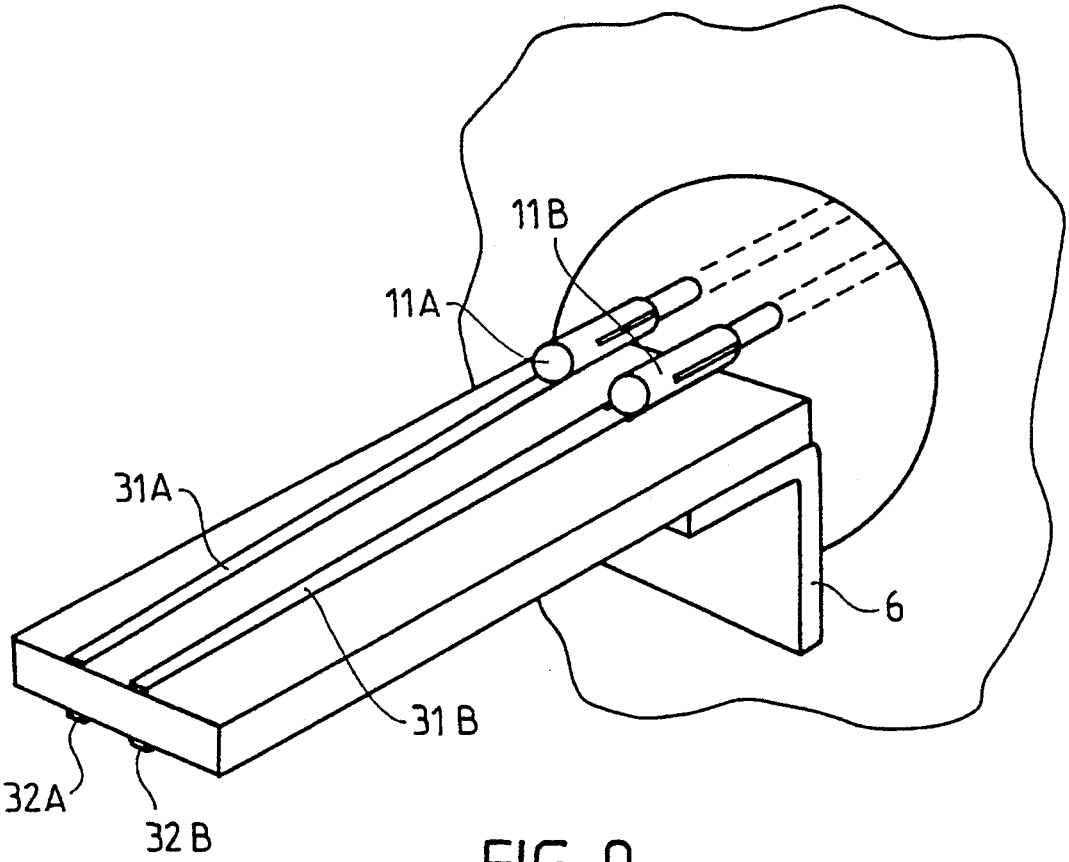
FIG. 9 shows a third embodiment, with two cables coming from the electronic enclosure situated on the same side with respect to the balun.
Figure 10:
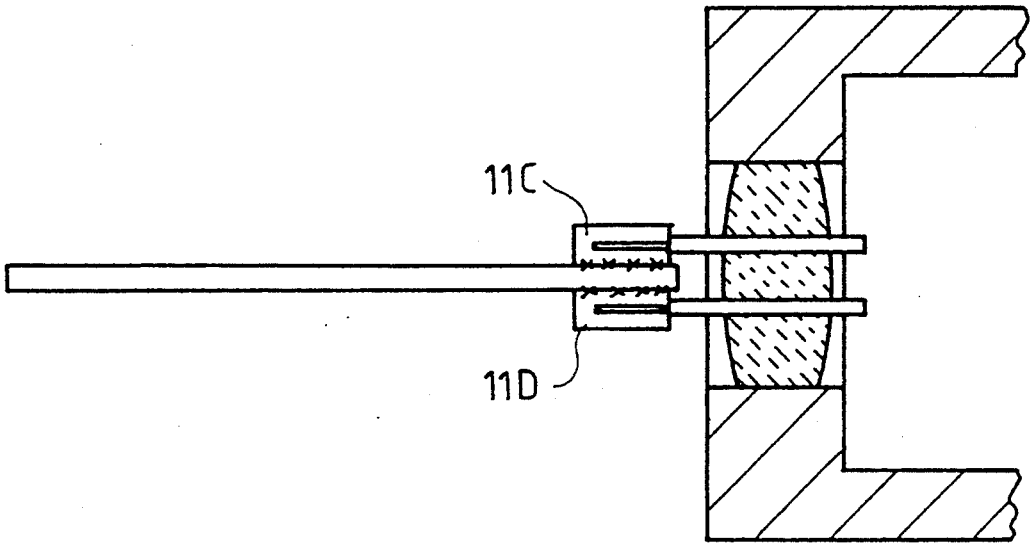
FIG. 10 shows the case of two cables situated on each side of the balun.

FIGS. 9 and 10 propose variants of the present invention, where several conductors pass through the glass bead.

In FIG. 9, the balun is multiple, with narrow tracks 31A and 31B respectively opposite wide tracks 32A and 32B.

There are therefore as many clamps 11A, 11B as conductors and/or narrow tracks, in corresponding positions, in this case on the same side of the balun. The earthing angle bracket 6 may be common to the two wide tracks.

As a variant, no earthing angle bracket (or other earth transfer conductor) is provided and all necessary connections are made by means of clamps.

FIG. 10 concerns the case in which an earthing angle bracket is not suitable, since active tracks (not connectable to earth) exist on both sides of the balun. Clamps 11C, 11D are then provided on both sides. This arrangement may also be used with an earthing angle bracket in particular cases.

In addition, the invention may be implemented so that the antenna enclosure and microelectronic enclosure form only a single mechanical piece.

I claim:

1. An electronic device, comprising an antenna enclosure having a circuit with an antenna etched thereon and a balun circuit for feeding the antenna, connected to a microelectronic enclosure provided with an airtight connection including a sealed glass bead at least one conducting wire passing through the glass bead, wherein the balun circuit comprises at least first and second tracks on each side of a dielectric substrate, at least one immediate electrical contact being provided between the conducting wire from the enclosure and the first of the tracks on the balun circuit, and having a direct mechanical fixing of the antenna enclosure to the microelectronic enclosure, including an earth transfer conductor connected to the second of the balun tracks and in contact with the microelectronic enclosure, the immediate contact between the conducting wire and the antenna balun using a clamp soldered to the balun and being configured to receive the conducting wire from the microelectronic enclosure.

2. The apparatus according to claim 1, wherein the earth transfer conductor comprises an earth transfer angle bracket.

3. The apparatus according to claim 1, wherein the glass bead on the enclosure has a plurality of conducting wires passing through, each wire being received in a corresponding clamp soldered directly to the balun.

4. The apparatus according to claim 3, wherein the clamps are situated on a same side of the balun.

5. The apparatus according to claim 3, wherein the clamps are distributed on both sides of the balun.

6. The apparatus according to claim 1 wherein the direct mechanical fixing is effected by screws.

* * * * *